US012117006B2

(12) United States Patent
Krutzenbichler et al.

(10) Patent No.: US 12,117,006 B2
(45) Date of Patent: Oct. 15, 2024

(54) CONVEYOR DEVICE AT LEAST FOR CONVEYING A FLUID AND PUMP COMPRISING SUCH A CONVEYOR DEVICE

(71) Applicant: Watson Marlow GmbH, Rommerskirchen (DE)

(72) Inventors: Alois Krutzenbichler, Starnberg (DE); Lars Freiherr Varnbuler Von Und Zu Hemmingen-Redschlag, Wiernsheim-Pinache (DE); Raymond Ritschka, Weissach (DE); Nico Haug, Sindelfingen (DE)

(73) Assignee: Watson Marlow GmbH, Rommerskirchen (DE)

( * ) Notice: Subject to any disclaimer, the term of this patent is extended or adjusted under 35 U.S.C. 154(b) by 0 days.

(21) Appl. No.: 17/755,197

(22) PCT Filed: Oct. 22, 2020

(86) PCT No.: PCT/EP2020/079816
§ 371 (c)(1),
(2) Date: Apr. 22, 2022

(87) PCT Pub. No.: WO2021/078897
PCT Pub. Date: Apr. 29, 2021

(65) Prior Publication Data

US 2022/0389927 A1 Dec. 8, 2022

(30) Foreign Application Priority Data

Oct. 23, 2019 (DE) ..... 102019128678.6

(51) Int. Cl.
*F04C 5/00* (2006.01)
*F04B 43/08* (2006.01)
(Continued)

(52) U.S. Cl.
CPC ..... *F04C 5/00* (2013.01); *F04B 43/08* (2013.01); *F04B 43/12* (2013.01); *F04B 53/20* (2013.01); *F04C 2240/802* (2013.01)

(58) Field of Classification Search
CPC ..... F04C 5/00; F04C 5/04; F04C 2240/802; F01C 5/00; F01C 5/02; F01C 5/04;
(Continued)

(56) References Cited

U.S. PATENT DOCUMENTS 2,885,966 A 5/1959 Ford
3,408,947 A * 11/1968 McMillan ..... F04C 5/00 418/45
(Continued)

FOREIGN PATENT DOCUMENTS

DE 102017104400 A1 9/2018
EP 1317626 B1 * 8/2006 ..... F04B 43/02
(Continued)

OTHER PUBLICATIONS

EP1317626-B1—Beenker J W—Method and Device for Conveying Media—Aug. 2, 2006—copy of the English Machine Translation (Year: 2006).*
(Continued)

*Primary Examiner* — Theresa Trieu
(74) *Attorney, Agent, or Firm* — Honigman LLP

(57) ABSTRACT

A conveyor device is disclosed for at least conveying a fluid with at least one conveyor chamber, with at least one dimensionally stable conveyor chamber element that at least partially delimits the conveyor chamber, with at least one elastically deformable and, in particular, annular conveyor element, particularly a conveyor membrane, that delimits the conveyor chamber together with the conveyor chamber element and is arranged on the conveyor chamber element, and with at least one pressing unit intended for generating an
(Continued)

inhomogeneous pressing force, particularly at least in a non-conveying state of the conveyor element, at least in a sealing region between the conveyor element and the conveyor chamber element along a maximum overall extent of the sealing region, particularly along a maximum circumferential extent between the conveyor element and the conveyor chamber element.

8 Claims, 7 Drawing Sheets

(51) Int. Cl.
*F04B 43/12* (2006.01)
*F04B 53/20* (2006.01)

(58) Field of Classification Search
CPC .. F01C 5/06; F04B 43/00; F04B 43/08; F04B 43/12; F04B 43/14; F04B 53/00; F04B 53/16; F04B 53/20; F04B 53/22; F05C 2225/00; F05C 2225/02
See application file for complete search history.

(56) References Cited

U.S. PATENT DOCUMENTS

| | | | | |
|---|---|---|---|---|
| 3,922,119 | A | 11/1975 | Rosenquist | |
| 4,332,534 | A | 6/1982 | Becker | |
| 2018/0051564 | A1* | 2/2018 | Braxmaier | F04C 5/00 |
| 2020/0256329 | A1* | 8/2020 | Freiherr Varnbüler Von Und Zu Hemmingen-Redschlag | F04C 5/00 |

FOREIGN PATENT DOCUMENTS

| | | | |
|---|---|---|---|
| EP | 2733355 | A1 | 5/2014 |
| GB | 583578 | A | 12/1946 |
| SU | 1670175 | A1 | 8/1991 |
| WO | 2015140207 | A1 | 9/2015 |
| WO | 2016173798 | A1 | 11/2016 |
| WO | 2018158423 | A1 | 9/2018 |
| WO | 2019005181 | A1 | 1/2019 |

OTHER PUBLICATIONS

International Search Report, Application No. PCT/EP2020/079816, mailed Nov. 30, 2020. ISA/European Patent Office.
German Patent Office Search Report, Application No. DE 10 2019 128 678.6, mailed Aug. 13, 2020.
Russian Office Action, Application No. 2022113566, dated Oct. 10, 2022.
Russian Search Report, Application No. 2022113566, dated Oct. 20, 2022.
Russian Decision to Grant, Application No. 2022113566, dated May 3, 2023.
IPRP and Written Opinion of the International Bureau of WIPO, International Application No. PCT/EP2020/079816, mailed May 5, 2022.
Russian Decision to Grant, Application No. 2022113566, dated Apr. 3, 2023.
Intellectual Property India, First Examination Report, Application No. 202227021872, mailed Aug. 25, 2022.
Japanese Office Action, Application No. JP 2022-523361 dated May 23, 2023.
Canadian Office Action, Application No. 3,158, 198, dated Jun. 15, 2023.
Australian Office Action, Application No. 2020370730, mailed Jul. 27, 2023.
Korean Office Action issued in Application No. 10-2022-7017344 dated Dec. 26, 2023, 18 pages.
Israel Office Action, Application No. 292165, dated Nov. 2, 2023.
European Notice of Allowance, Application No. 20800030.7, dated Sep. 18, 2023.

* cited by examiner

CONVEYOR DEVICE AT LEAST FOR CONVEYING A FLUID AND PUMP COMPRISING SUCH A CONVEYOR DEVICE

CROSS-REFERENCE TO RELATED APPLICATIONS

This application is the U.S. national stage of PCT/EP2020/079816 filed on Oct. 22, 2020, which claims priority of German Patent Application No. 10 2019 128 678.6 filed on Oct. 23, 2019, the contents of which are incorporated herein.

TECHNICAL FIELD

The disclosure relates to a conveyor device for at least conveying a fluid and to a pump with such a conveyor device.

BACKGROUND

A conveyor device for at least conveying a fluid is already known from DE 10 2017 104 400 A1, wherein the already known conveyor device comprises at least one conveyor chamber, at least one dimensionally stable conveyor chamber element that at least partially delimits the conveyor chamber and at least one elastically deformable and particularly annular conveyor element that delimits the conveyor chamber together with the conveyor chamber element and is arranged on the conveyor chamber element. DE 10 2017 104 400 A1 also discloses a pump with such a conveyor device.

Furthermore, conveyor devices for at least conveying a fluid are already known from U.S. Pat. Nos. 2,885,966 and 3,922,119, wherein these conveyor devices comprise at least one conveyor chamber, at least one dimensionally stable conveyor chamber element that at least partially delimits the conveyor chamber, at least one elastically deformable conveyor element that delimits the conveyor chamber together with the conveyor chamber element and is arranged on the conveyor chamber element and at least one pressing unit that is intended for generating an inhomogeneous pressing force at least in a sealing region between the conveyor element and the conveyor chamber element along a maximum overall extent of the sealing region.

SUMMARY

The disclosure particularly is based on the objective of making available a conveyor device and/or a pump of the initially described type, which has/have improved properties with respect to an advantageous conveying function. According to the disclosure, this objective is attained with the characteristics of claim 1 whereas advantageous embodiments and enhancements of the disclosure can be gathered from the dependent claims.

The disclosure is based on a conveyor device for at least conveying a fluid with at least one conveyor chamber, with at least one dimensionally stable conveyor chamber element that at least partially delimits the conveyor chamber, with at least one elastically deformable and, in particular, annular conveyor element, particularly a conveyor membrane, that delimits the conveyor chamber together with the conveyor chamber element and is arranged on the conveyor chamber element, and with at least one pressing unit that is intended for generating an inhomogeneous pressing force, particularly at least in a non-conveying state of the conveyor element, at least in a sealing region between the conveyor element and the conveyor chamber element along a maximum overall extent of the sealing region, particularly along a maximum circumferential extent between the conveyor element and the conveyor chamber element.

It is proposed that the pressing unit is designed in such a way that the conveyor element has an inhomogeneous compression, particularly at least in a non-conveying state of the conveyor element, along the maximum overall extent of the sealing region, particularly along a maximum circumferential extent of the annular conveyor element, wherein the conveyor element particularly is compressed to different degrees by the pressing unit along the maximum overall extent of the sealing region, particularly along the maximum circumferential extent of the annular conveyor element, as a result of a geometric design of a pressing surface of a pressing element of the pressing unit. The pressing unit preferably is intended for generating an inhomogeneous pressing force distribution along a sealing line of the conveyor element, which particularly extends along a circumferential direction of the conveyor element. An inhomogeneous pressing force preferably is generated as a result of a special geometric design of a pressing surface of a pressing element and/or a special geometric design of a sealing extension of the conveyor element. A design or a progression/distribution of the inhomogeneous pressing forces particularly is dependent on maximum force peaks or maximum load peaks along the sealing line that result from a conveyance of a fluid, particularly its compression by means of an interaction of the conveyor element and the conveyor chamber element due to the effect of a drive unit of a pump comprising the conveyor device. The pressing unit preferably is designed in such a way that the sealing extension of the conveyor element is compressed to different degrees at different positions along the conveyor element or the sealing line, in particular as a result of an interaction of at least the pressing unit, particularly at least one pressing element of the pressing unit, and the sealing extension. The conveyor element may have an elongate design, particularly a prolate design, or an annular design. A basic functionality of the pressing unit with respect to the generation of an inhomogeneous pressing force or an inhomogeneous compression along the sealing line preferably is dependent on a shape of the conveyor element as such. The conveyor element may be designed in the form of a flat conveyor membrane, an annular conveyor membrane or a different conveyor membrane deemed sensible by a person skilled in the art, e.g. in the form of a plate-shaped or disk-shaped conveyor membrane or the like. A geometric design of the pressing surface and a geometric design of the sealing extension interacting with the pressing surface preferably are responsible for generating an inhomogeneous pressing force or an inhomogeneous compression along the sealing line. The sealing extension preferably is arranged on a conveying side of a base body of the conveyor element. The conveying side of the base body preferably is arranged on a side of the base body facing away from an activation side of the base body. The conveying side particularly forms an outer side of the base body. The activation side preferably forms an inner side of the base body. At least one activation extension of the conveyor element preferably is arranged on the activation side. The activation extension preferably is intended for interacting with a transmission element of a drive unit of a pump comprising the conveyor device, particularly with at least two transmission elements of the drive unit. The transmission element/s preferably is/are arranged on a driving element of the drive unit of the pump comprising the conveyor device. The base body preferably has an annular design. The base body particularly has a slotted annular design. Viewed in a plane, particularly in a plane extending at least essentially perpendicular to a drive axis of the drive shaft, the base body particularly has a cross-sectional shape that essentially is composed of a circular arc or an open ring, which extends along an angular range of less than 360° and, in particular, more than 90°, and two inlet and/or outlet extensions, which extend transverse to the circular arc or to the open ring and directly border on the circular arc or the open ring, particularly in end regions of the circular arc or the open ring. The activation extension preferably is arranged on the base body, particularly on an inner side of the base body, in the region of a circular arc extent or ring extent of the base body. A maximum longitudinal extent of the activation extension particularly is at least 5% smaller, preferably 10% smaller and especially at least 20% smaller, than a maximum longitudinal extent of the base body. The activation extension preferably extends at least essentially along an overall extent of the circular arc or the open ring of the base body, particularly up to end regions of the circular arc or the open ring, on which an inlet and/or outlet extension of the base body is respectively arranged. The activation extension particularly extends on the activation side along an angular range of less than 360°, preferably less than 350° and especially more than 180°.

The conveyor element, particularly the conveyor membrane, advantageously can be moved away from the counter surface of the conveyor chamber element, particularly lifted off the counter surface, as a result of the effect of a driving force that acts in a direction facing away from the activation side, particularly in order to generate a vacuum in the conveyor chamber. A vacuum that particularly is lower than −0.1 bar, preferably lower than −0.2 bar and especially lower than −0.3 bar, particularly referred to an atmospheric pressure surrounding the conveyor device, preferably can be generated as a result of a movement of the conveyor element, particularly the conveyor membrane, away from the counter surface. This makes it possible to achieve an advantageous conveyance of a medium to be conveyed into the conveyor chamber of the conveyor device, which is at least partially delimited by the counter surface and the conveying surface.

The conveyor element, particularly the conveyor membrane, preferably can be driven by means of the drive unit in such a way that a conveyance of a medium to be conveyed, particularly a fluid, can be realized in accordance with a traveling wave principle (see, e.g., the disclosure of EP 1 317 626 B1). The drive unit may be designed in the form of a mechanical drive unit, a magnetic drive unit, a piezoelectric drive unit, a hydraulic drive unit, a pneumatic drive unit, an electric drive unit, a magnetorheologic drive unit, a carbontubes drive unit, a combination of the aforementioned types of drive units or in the form of a different drive unit deemed sensible by a person skilled in the art. The drive unit preferably has at least the driving element that is intended for acting upon the conveyor element, particularly the conveyor membrane. However, it is also conceivable that the drive unit has more than one driving element intended for acting upon the conveyor element. The driving element preferably is intended for causing an elastic deformation of the conveyor element, particularly the conveyor membrane, as a result of an effect of a driving force on the conveyor element, particularly the conveyor membrane. The driving element may have any design deemed sensible by a person skilled in the art, e.g. in the form of a plunger, an extension, an engagement ring, a hook, a gripping element or the like. The driving element preferably is designed in the form of an eccentric shaft. The eccentric shaft preferably can be driven in a rotating manner by means of a motor unit of a pump comprising the conveyor device in a manner familiar to a person skilled in the art. The motor unit may be designed in the form of an electric motor unit, an internal combustion engine unit, a hybrid motor unit or the like. The driving element preferably has a rotational axis. The rotational axis preferably extends transverse, particularly at least essentially perpendicular, to a principal conveying direction of the conveyor chamber, along which a fluid can be conveyed through the conveyor chamber. The term "essentially perpendicular" particularly defines an alignment of a direction relative to a reference direction, wherein the direction and the reference direction include an angle of 90°, particularly viewed in a plane of projection, and the angle has a maximum deviation, in particular, of less than 8°, preferably less than 5° and especially less than 2°.

The conveyor chamber of the conveyor device preferably is delimited by the base body of the conveyor element and the conveyor chamber element. The conveyor chamber of the conveyor device particularly is delimited by the conveying surface and the counter surface lying opposite of the conveying surface. The conveyor chamber element preferably is designed in a dimensionally stable manner. The conveyor chamber element preferably has a prestress, particularly for exerting a force upon the conveyor element in the direction of the pressing unit. The conveyor element, particularly the conveyor membrane, preferably is designed in an elastically resilient manner. The term "elastically resilient" particularly refers to a property of an element, particularly the conveyor element, which particularly is intended for generating a counterforce that is dependent on a change of a shape of the element, preferably proportional to the change, and counteracts the change. The conveyor element, particularly the conveyor membrane, preferably can be deformed repeatedly, particularly without thereby mechanically damaging or destroying the conveyor element, particularly the conveyor membrane. The conveyor element, particularly the conveyor membrane, preferably seeks to automatically reassume, particularly after a deformation, a basic shape, especially a convexly curved basic shape referred to the counter surface, particularly a zero position of the conveyor element, particularly the conveyor membrane. The elastically resilient design of the conveyor element, particularly the conveyor membrane, preferably can be at least partially influenced and/or caused by means of a particularly geometric design of the base body and/or by means of an arrangement of the conveyor element, particularly the conveyor membrane, on the conveyor chamber element having the counter surface. The conveyor element, particularly the conveyor membrane, preferably is arranged on the conveyor chamber element having the counter surface in such a way a conveyance of a fluid takes place in and/or through the conveyor chamber as a result of an indentation of the conveyor element, particularly the conveyor membrane. After an effect of a driving force on the conveyor element, particularly the conveyor membrane, ceases in order to convey a fluid, the conveying surface of the conveyor element, particularly the conveyor membrane, preferably seeks to reassume a convexly curved arrangement referred to the counter surface in an at least essentially automatic manner, particularly as a result of the elastically resilient design. The conveyor element, particularly the conveyor membrane, preferably is made of a rubber-like and/or caoutchouc-like material. However, it is also conceivable that the conveyor device, particularly the conveyor membrane, consists of a different material deemed sensible by a person skilled in the art or of a combination of multiple materials, which allow/allows an elastically resilient design of the conveyor element, particularly the conveyor membrane. The conveyor element, particularly the conveyor membrane, preferably utilizes an "indentation effect" in order to convey a fluid in and/or through the conveyor chamber. The conveyor element, particularly the conveying surface, preferably can be at least temporarily indented in order to convey a fluid, wherein at least one indentation can be displaced, particularly in a rolling manner, along the conveying surface in order to convey a fluid. The term "intended" particularly means specially constructed, specially designed and/or specially equipped. The phrase an element and/or a unit is/are intended for a certain function particularly means that the element and/or the unit fulfills/fulfill and/or carries out/carry out this certain function in at least an application state and/or operational state.

The term "non-conveying state" in particular refers to a state of the conveying surface, particularly viewed in at least a partial region of the conveying surface, in which the conveying surface is not deformed, particularly spaced apart from a counter surface by the maximum distance, and decoupled from an effect of a driving force for conveying a medium to be conveyed by means of the conveying surface, particularly in at least a partial region of the conveying surface. The conveyor element preferably has an inhomogeneous compression at different positions of the sealing region along the maximum overall extent of the sealing region, particularly along a maximum circumferential extent of the annular conveyor element, as a result of a design of the pressing unit, particularly as a result of a geometric design of the pressing surface. The conveyor element particularly is compressed to different degrees by the pressing unit along the maximum overall extent of the sealing region, particularly along a maximum circumferential extent of the annular conveyor element, as a result of a geometric design of the pressing surface. The inventive design makes it possible to achieve a pressing force distribution, which is adapted to a load caused by a conveyance of a fluid in a particularly advantageous manner, along a sealing line between the conveyor chamber element and the conveyor element. A sealing function that is adapted to a load can be advantageously achieved. A reliable conveyance of a fluid can be achieved in a particularly advantageous manner. A reliable seal can be advantageously achieved. A leak can be advantageously counteracted. An efficient conveyance of a fluid can be advantageously realized.

It is furthermore proposed that the pressing unit has at least one pressing element, particularly at least one clamping ring, wherein the conveyor element is designed in an annular manner and, in particular, the sealing extension of the conveyor element is pressed against an inner circumference of the annular conveyor chamber element, particularly along the maximum overall extent of the sealing region, with different intensities by means of the pressing element. The pressing element acts upon the conveyor element with a pressing force that acts at least essentially parallel to a rotational axis of a driving element of the drive unit. In this context, the term "essentially parallel" particularly refers to an alignment of a direction relative to a reference direction, in particular in a plane, wherein a deviation of the direction relative to the reference direction particularly amounts to less than 8°, preferably less than 5° and especially less than 2°. The pressing element preferably acts upon the conveyor element with an additional pressing force that acts transverse, particularly at least essentially perpendicular, to the rotational axis of the driving element. The pressing element particularly comprises a circumferential collar for generating a pressing force that acts upon the conveyor element essentially parallel to the rotational axis of the driving element. The pressing unit preferably comprises at least two pressing elements, particularly at least two clamping rings, by means of which the conveyor element, in particular the sealing extension of the conveyor element, is pressed against the inner circumference of the annular conveyor chamber element with different intensities, particularly along the maximum overall extent of the sealing region. The conveyor element preferably is arranged within the conveyor chamber element between the at least two pressing elements. The inventive design makes it possible to advantageously realize a multidimensional pressing effect on the conveyor element. A reliable seal can be advantageously achieved. A leak can be advantageously counteracted. An efficient conveyance of a fluid can be advantageously realized. A reliable conveyance of a fluid can be achieved in a particularly advantageous manner.

In addition, it is proposed that the pressing unit has at least one pressing element, particularly the aforementioned pressing element, especially at least one clamping ring, wherein the conveyor element has at least one sealing extension, particularly the aforementioned sealing extension, and wherein the pressing element presses the sealing extension against the conveyor chamber element, particularly at least along a circumferential direction of the conveyor chamber element, with an inhomogeneous pressing force along the circumferential direction. A principal direction of action of the inhomogeneous pressing force preferably is aligned transverse, particularly at least essentially perpendicular, to the rotational axis of the driving element. The inventive design makes it possible to advantageously achieve a reliable seal. A leak can be advantageously counteracted. An efficient conveyance of a fluid can be advantageously realized. A reliable conveyance of a fluid can be achieved in a particularly advantageous manner.

It is furthermore proposed that the pressing unit has at least one pressing element, particularly at least one clamping ring, wherein the pressing element has a pressing surface that has a varying level, in particular a varying distance from a surface, particularly an inner surface, of the pressing element facing away from the pressing surface along a maximum longitudinal extent of the pressing surface, in particular, in a circumferential direction of the pressing element. The varying level of the pressing surface preferably is formed by a different curvature along the overall extent of the pressing surface, particularly along a circumferential direction extending in a plane that lies at least essentially perpendicular to the rotational axis of the driving element. However, it is also conceivable that the varying level of the pressing surface is formed by different maximum heights of elevations in the pressing surface, particularly along the circumferential direction extending in the plane that lies at least essentially perpendicular to the rotational axis of the driving element. It is also conceivable that the varying level of the pressing surface is formed by different maximum thicknesses of an edge of the pressing element, particularly a collar of the pressing element, on which the pressing surface is arranged on the pressing element on a side arranged [sic] the conveyor element. Other designs of the pressing surface deemed sensible by a person skilled in the art for realizing the varying level of the pressing surface are likewise conceivable. The inventive design makes it possible to advantageously realize a multidimensional pressing effect on the conveyor element. A reliable seal can be advantageously achieved. A leak can be advantageously counteracted. An efficient conveyance of a fluid can be advantageously realized. A reliable conveyance of a fluid can be achieved in a particularly advantageous manner.

It is furthermore proposed, in particular alternatively or additionally, that the conveyor element has at least one sealing extension, particularly the aforementioned sealing extension, which is pressed against an inner circumference of the annular conveyor chamber element by means of the pressing unit and has a varying maximum thickness along a maximum longitudinal extent of the sealing extension, particularly along a circumferential direction of the conveyor element. The maximum thickness preferably is formed by a maximum extent, particularly a maximum height, of the sealing extension viewed, in particular, along a direction extending at least essentially perpendicular to the conveying surface. However, it is also conceivable that the maximum thickness of the sealing extension is formed by a maximum extent of the sealing extension starting from the conveying surface, particularly viewed along a direction extending at least essentially perpendicular to the conveying surface. The inventive design makes it possible to advantageously achieve a strong effect of the pressing unit, in particular alternatively or additionally to the effect of the pressing element. A multidimensional pressing effect on the conveyor element can be advantageously realized. A reliable seal can be advantageously achieved. A leak can be advantageously counteracted. An efficient conveyance of a fluid can be advantageously realized. A reliable conveyance of a fluid can be achieved in a particularly advantageous manner.

In addition, it is proposed that the pressing unit has at least one pressing element, particularly the aforementioned pressing element, especially at least one clamping ring, and at least one additional pressing element, particularly at least one additional clamping ring, wherein the conveyor element is designed in an annular manner and pressed against an inner circumference of the annular conveyor chamber element by means of the pressing element and the additional pressing element, and wherein the pressing element and the additional pressing element are arranged on the conveyor element on opposite sides of the conveyor element. Viewed along the rotational axis of the driving element, in particular, the conveyor element preferably is arranged between the pressing element and the additional pressing element, particularly within the conveyor chamber element. The inventive design makes it possible to advantageously achieve a high pressing force of the conveyor element against the conveyor chamber element. An advantageous effect of the pressing unit can be achieved. A multidimensional pressing effect on the conveyor element can be advantageously realized. A reliable seal can be advantageously achieved. A leak can be advantageously counteracted. An efficient conveyance of a fluid can be advantageously realized. A reliable conveyance of a fluid can be achieved in a particularly advantageous manner.

It is furthermore proposed that the conveyor chamber element has at least one groove, particularly a sealing groove, that extends, in particular, along an inner circumference of the annular conveyor chamber element, wherein at least one sealing extension of the particularly annular conveyor element is pressed into said groove by means of a pressing element of the pressing unit, particularly a clamping ring of the pressing unit, and wherein a compression of the sealing extension is inhomogeneous along a maximum longitudinal extent of the sealing extension, in particular, along a circumferential direction of the conveyor element. Alternatively or additionally to a varying level of the pressing surface and/or the varying thickness of the sealing extension, it is also conceivable that the sealing groove has a varying level, particularly for realizing an inhomogeneous pressing force along the sealing line. The inventive design makes it possible to achieve an advantageous effect of the pressing unit. A multidimensional pressing effect on the conveyor element can be advantageously realized. A reliable seal can be advantageously achieved. A leak can be advantageously counteracted. An efficient conveyance of a fluid can be advantageously realized. A reliable conveyance of a fluid can be achieved in a particularly advantageous manner.

In addition, a pump with at least one inventive conveyor device is proposed. The pump preferably is intended for use in a food sector, a chemical sector, a pharmaceutical sector, particularly for batch-compliant use, a vivarium sector (aquarium, etc.), a domestic appliance sector, a dental hygiene sector, an automobile sector, a medical sector, a water treatment sector or the like. The inventive design makes it possible to achieve a reliable conveyance of a fluid in a particularly advantageous manner. A reliable seal can be advantageously achieved. A leak can be advantageously counteracted. An efficient conveyance of a fluid can be advantageously realized. A pressing force distribution, which is adapted to a load caused by a conveyance of a fluid in a particularly advantageous manner, can be advantageously achieved along a sealing line between the conveyor chamber element and the conveyor element.

It is furthermore proposed that the pump comprises at least one drive unit, particularly the aforementioned drive unit, that has at least one driving element, particularly the aforementioned driving element, especially at least one eccentric shaft that for the most part is surrounded by the conveyor chamber element, the conveyor element and the pressing unit, particularly viewed along a circumferential direction extending around the drive axis of the drive unit. The drive unit, particularly at least the driving element, preferably is completely surrounded by the conveyor chamber element, the conveyor element and the pressing unit, particularly viewed along the circumferential direction extending around the drive axis of the drive unit. The inventive design makes it possible to advantageously realize a compact and powerful pump. Easy serviceability can be advantageously achieved, particularly because the conveyor device as a whole can be removed from the housing together with the drive unit. The conveyance of a medium to be conveyed can be realized.

The inventive pump and/or the inventive conveyor device is/are not limited to the above-described application and embodiment. The number of individual elements, components and units of the inventive pump and/or the inventive conveyor device for fulfilling a function described herein particularly may differ from the number mentioned herein. With respect to the value ranges specified in this disclosure, values lying within the mentioned limits should also be considered as being disclosed and arbitrarily applicable.

BRIEF DESCRIPTION OF DRAWINGS

Other advantages arise from the following description of the drawings. The drawings show an exemplary embodiment of the disclosure. The drawings, the description and the claims contain numerous characteristics in combination. A person skilled in the art will also expediently consider these characteristics individually and combine them into other sensible combinations.

DETAILED DESCRIPTION OF THE EXEMPLARY EMBODIMENT

Figure 1:
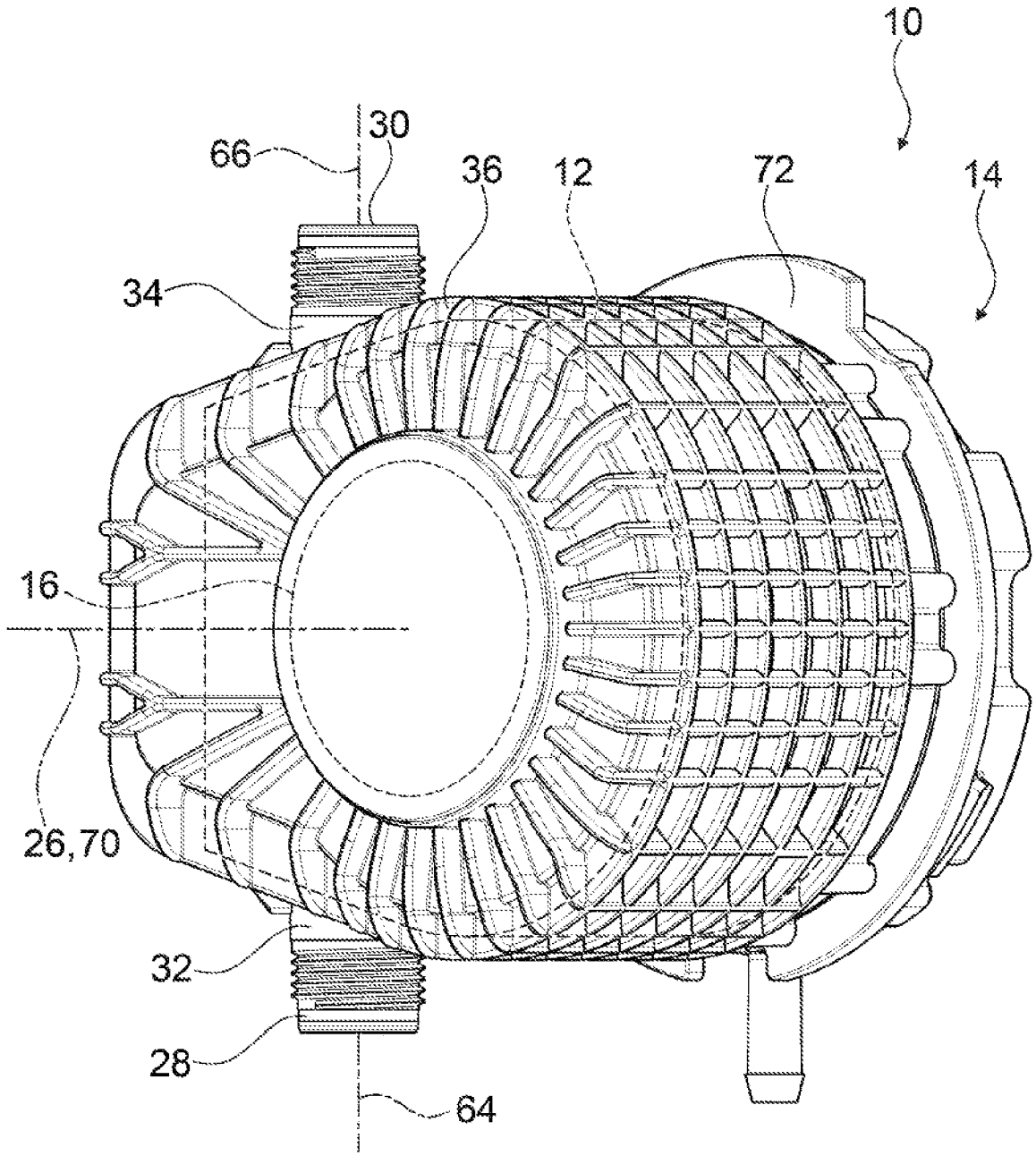
FIG. 1 shows a schematic representation of an inventive pump with an inventive conveyor device.

FIG. 1 shows a pump 10 with a conveyor device 12 for at least conveying a (not-shown) fluid. The conveyor device 12 is designed for at least conveying a fluid, in particular as a result of an effect of a drive unit 16 of the pump 10 on the conveyor device 12, particularly on an elastically deformable conveyor element 22 of the conveyor device 12. The conveyor device 12 comprises at least one conveyor chamber 18, at least one dimensionally stable conveyor chamber element 20 that at least partially delimits the conveyor chamber 18 and at least the elastically deformable, particularly annular, conveyor element 22 that delimits the conveyor chamber 18 together with the conveyor chamber element 20 and is arranged on the conveyor chamber element 20 (see FIG. 4). The conveyor element 22 preferably is designed in the form of a conveyor membrane. The conveyor chamber element 20 is at least mostly, in particular completely, made of a plastic, particularly an injection-moulded plastic. However, it is also conceivable that the conveyor chamber element 20 is made of a different material deemed sensible by a person skilled in the art. The conveyor element 22 preferably is at least mostly, in particular completely, made of a rubber, particularly a synthetic rubber such as EPDM, FC, NBR or the like. However, it is also conceivable that the conveyor element 22 is made of a different material deemed sensible by a person skilled in the art.

The pump 10 comprises at least the drive unit 16 for acting upon the conveyor device 12 and at least one housing 14 for accommodating the conveyor device 12. The drive unit 16 preferably comprises at least one driving element 24 for acting upon the conveyor device 12 (see FIG. 4). The driving element 24 preferably is designed in the form of an eccentric shaft. However, it is also conceivable that the drive unit 24 has a different design deemed sensible by a person skilled in the art, e.g. in the form of a rotationally symmetrical shaft, on which at least one cam for acting upon the conveyor device 12 is arranged, or the like. The driving element 24 may be connected to a drive shaft of a (not-shown) motor unit such as an electric motor, an internal combustion engine, a pneumatic engine or the like either directly, particularly in a rotationally fixed manner, or indirectly, e.g. by means of a gear unit or a means of at least one gearwheel element. The driving element 24 has a rotational axis 26 that extends transverse, particularly at least essentially perpendicular, to a principal conveying direction, along which a fluid can be conveyed through the conveyor chamber 18.

The conveyor device 12 preferably is at least mostly, in particular completely, arranged within the housing 14. The conveyor device 12 is at least mostly, in particular completely, surrounded by the housing 14. A person skilled in the art knows that the housing 14 particularly is intended for enveloping and/or supporting the conveyor device 12 and/or the drive unit 16 of the pump 10 at least partially, in particular completely. The housing 14 may be made of a plastic, a metal, a combination of plastic and metal or of a different material deemed sensible by a person skilled in the art. The housing 14 may have a shell design, a pot design, a combination of a shell design and a pot design or a different design deemed sensible by a person skilled in the art.

The housing 14 is formed at least separately from the conveyor chamber element 20 of the conveyor device 12, particularly from the conveyor device 12 as a whole, namely in such a way that the conveyor chamber element 20, particularly the conveyor device 12 as a whole, can be removed from the housing 14. The conveyor chamber element 20, particularly the conveyor device 12 as a whole, preferably can be removed from the housing 14 after the removal of an upper housing part 36, particularly together with the conveyor element 22 arranged on the conveyor chamber element 20. The conveyor device 12 preferably can be removed from the housing 14 as a whole, particularly after the removal of the upper housing part 36 of the housing 14, such that it is decoupled from a removal of individual components of the conveyor device 12. When the conveyor device 12, particularly the conveyor device 12 as a whole, is arranged in the housing 14, in particular, the housing 14 surrounds at least the conveyor chamber element 20, particularly the conveyor device 12, at least mostly along a circumferential direction extending in a plane that lies essentially perpendicular to a drive axis 70 of the drive unit 16.

Figure 2:
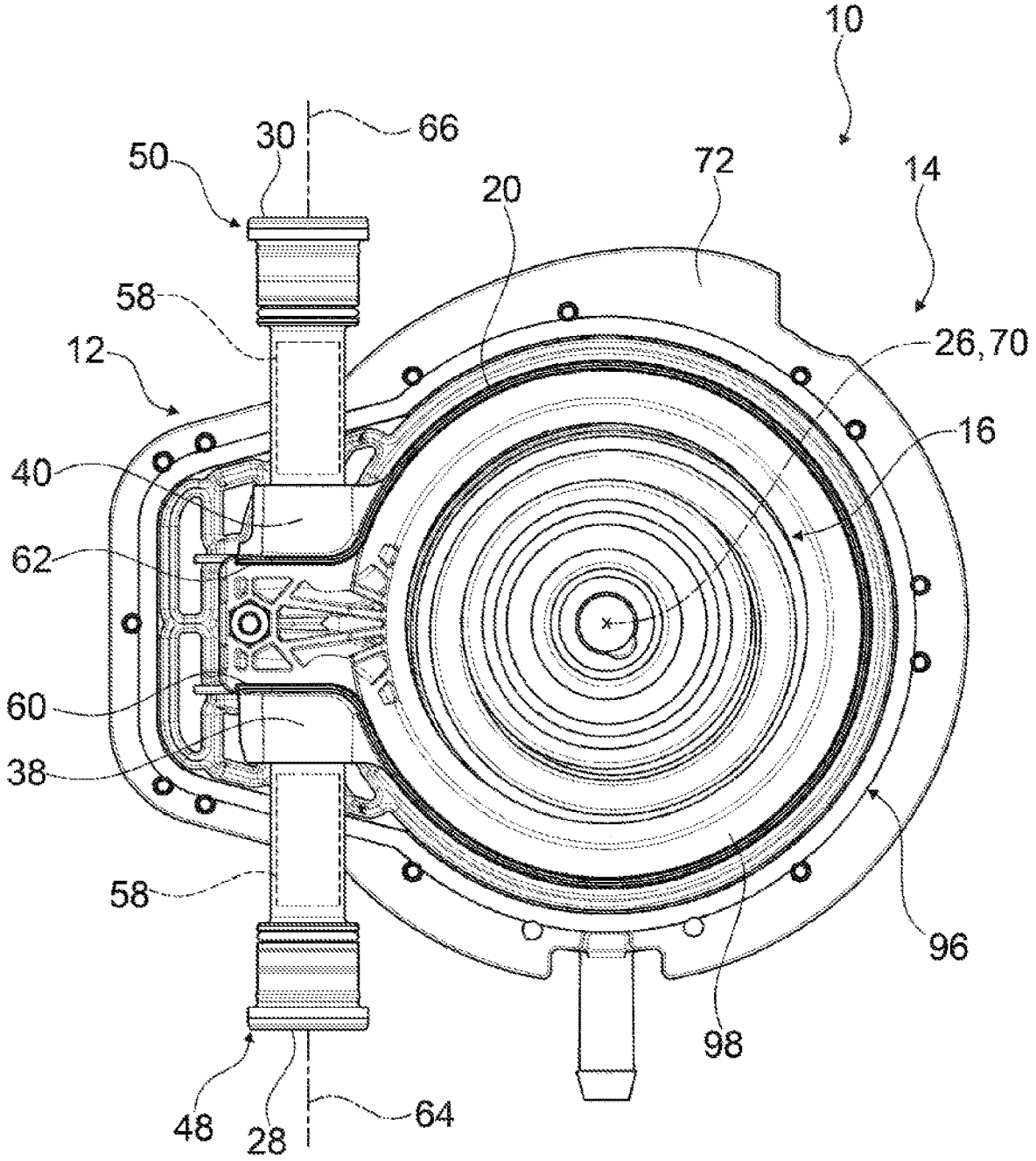
FIG. 2 shows a schematic representation of the inventive pump with an opened housing.

Viewed along a direction extending transverse to the drive axis 70 of the drive unit 16, the conveyor chamber element 20 is arranged at least between the housing 14 and the conveyor element 22 of the conveyor device 12, in particular directly adjacent to the housing 14 or directly abutting on the housing 14 (see FIG. 2). When the conveyor device 12 is arranged in the housing 14, the conveyor device 12 at least essentially surrounds the drive unit 16 completely, particularly along a circumferential direction extending in a plane that lies at least essentially perpendicular to the drive axis 70 of the drive unit 16. When the conveyor device 12 is arranged in the housing 14, an outer side of the conveyor chamber element 20 is connected to an inner side of the housing 14 in a frictionally engaged and/or form-fitting manner and, in particular, preferably abuts directly on the inner side of the housing 14. When the conveyor device 12, particularly the conveyor device 12 as a whole, is arranged in the housing 14, the outer side of the conveyor chamber element 20 preferably abuts at least partially on the inner side of the housing 14, particularly at least on an inner side of the lower housing part 72 of the housing 14. The conveyor chamber element 20 preferably abuts on the inner side of the housing 14, particularly on the inner side of the lower housing part 72 of the housing 14, with more than 30%, preferably more than 40% and less than 95%, particularly between 40% and 60%, of the entire outer surface of its outer side. The housing 14 preferably has a recess, in which the conveyor device 12 can be arranged or particularly is arranged. The recess of the housing 14, particularly of the lower housing part 72, preferably is delimited by a collar-like extension in the interior of the housing 14, particularly the lower housing part 72. The collar-like extension extends over less than 360°, in particular, in order to allow the arrangement of an inlet and outlet region of the conveyor device 12 in the housing 14, particularly in the lower housing part 72.

The housing 14 furthermore comprises at least one receptacle 32, particularly at least two receptacles 32, 34, for accommodating at least one fluid supply line adapter 28 and/or one fluid discharge line adapter 30 of the conveyor device 12. The fluid supply line adapter 28 preferably is intended for being connected to a fluid line, particularly for realizing a supply of fluid to the conveyor chamber 18. The fluid discharge line adapter preferably is intended for being connected to a fluid line, particularly for realizing a discharge of fluid from the conveyor chamber 18. The receptacle/s 32, 34 preferably is/are arranged in the upper housing part 36 of the housing 14 (see FIGS. 1 and 3). However, it is also conceivable that the receptacle/s 32, 34 is/are arranged in another component of the housing 14, e.g. in the lower housing part 72 or the like. The fluid supply line adapter 28 and/or the fluid discharge line adapter 30 preferably is connected to the receptacle/s 32, 34, particularly fixed on the receptacle/s 32, 34, by means of a form-fitting and/or frictional connection. For example, the receptacle/s 32, 34 comprises/comprise on an inner side an internal thread for fixing the fluid supply line adapter 28 and/or the fluid discharge line adapter 30 on the housing 14, particularly on the upper housing part 36 (see FIG. 3). However, it is also conceivable that the fluid supply line adapter 28 and/or the fluid discharge line adapter 30 is/are arranged, particularly secured, on the receptacle/s 32, 34 by means of a different connection, particularly a threadless form-fitting connection that is produced, e.g., by means of an insertion into the receptacle/s 32, 34. The receptacle/s 32, 34 extends/extend continuously from an outer side of the housing 14, particularly the upper housing part 36, up to an inner side of the housing 14, particularly the upper housing part 36. The receptacle/s 32, 34 preferably is/are designed in the form of a through-opening/through-openings from the outer side to the inner side of the housing 14. When the conveyor device 12 is arranged in the housing 14, the fluid supply line adapter 28 and/or the fluid discharge line adapter 30 extends/extend from the conveyor chamber element 20 at least up to, particularly beyond, the outer side of the housing 14, particularly when a connecting piece 38 of the conveyor chamber element 20 is connected to the fluid supply line adapter 28 and/or when, in particular, an additional connecting piece 40 of the conveyor chamber element 20 is connected to the fluid discharge line adapter 30 (see FIG. 3).

The connecting piece 38 and/or, in particular, the additional connecting piece respectively is/are arranged on at least one transverse extension 60, 62 of the conveyor chamber element 20, particularly designed integrally with the corresponding transverse extension 60, 62 (see FIGS. 2, 3, 5 and 7). Viewed in a plane, particularly a plane extending at least essentially perpendicular to a rotational axis 26 of the driving element 24, in particular to the drive axis 70 of the drive unit 16, the conveyor chamber element 20 particularly has a cross-sectional shape that essentially is composed of a circular arc or an open ring, which extends along an angular range of less than 360° and, in particular, more than 90°, and the two transverse extension 60, 62, which extend transverse to the circular arc or the open ring and directly border on the circular arc or the open ring, particularly in end regions of the circular arc or the open ring. The connecting piece 38 and/or, in particular, the additional connecting piece 40 respectively has/have a principal axis 64, 66 that extends transverse, particularly at least essentially perpendicular, to a principal plane of the at least one transverse extension 60, 62, particularly the respective transverse extension 60, 62. The principal axis/axes 64, 66 of the connecting piece 38 and/or, in particular, the additional connecting piece 40 preferably extend transverse, particularly at least essentially perpendicular, to the principal conveying direction of the conveyor chamber 18, along which a fluid can be conveyed through the conveyor chamber 18. The principal axis/axes 64, 66 of the connecting piece 38 and/or, in particular, the additional connecting piece 40 preferably extend at least essentially parallel to the plane that lies at least essentially perpendicular to the rotational axis 26 of the driving element 24. The connecting piece 38 and, in particular, the additional connecting piece 40 are arranged on the side, particularly on the outer side, of the conveyor chamber element 20 facing away from the conveyor element 22 such that they are aligned differently, particularly in an opposed manner. The connecting piece 38 and, in particular, the additional connecting piece 40 preferably extend in different directions, particularly in opposite directions, starting from the outer side of the conveyor chamber element 20. The connecting piece 38 and, in particular, the additional connecting piece 40 preferably extend in directions that face away from the conveyor chamber element 20 and are aligned in an opposed manner starting from the outer side of the conveyor chamber element 20.

Figure 3:
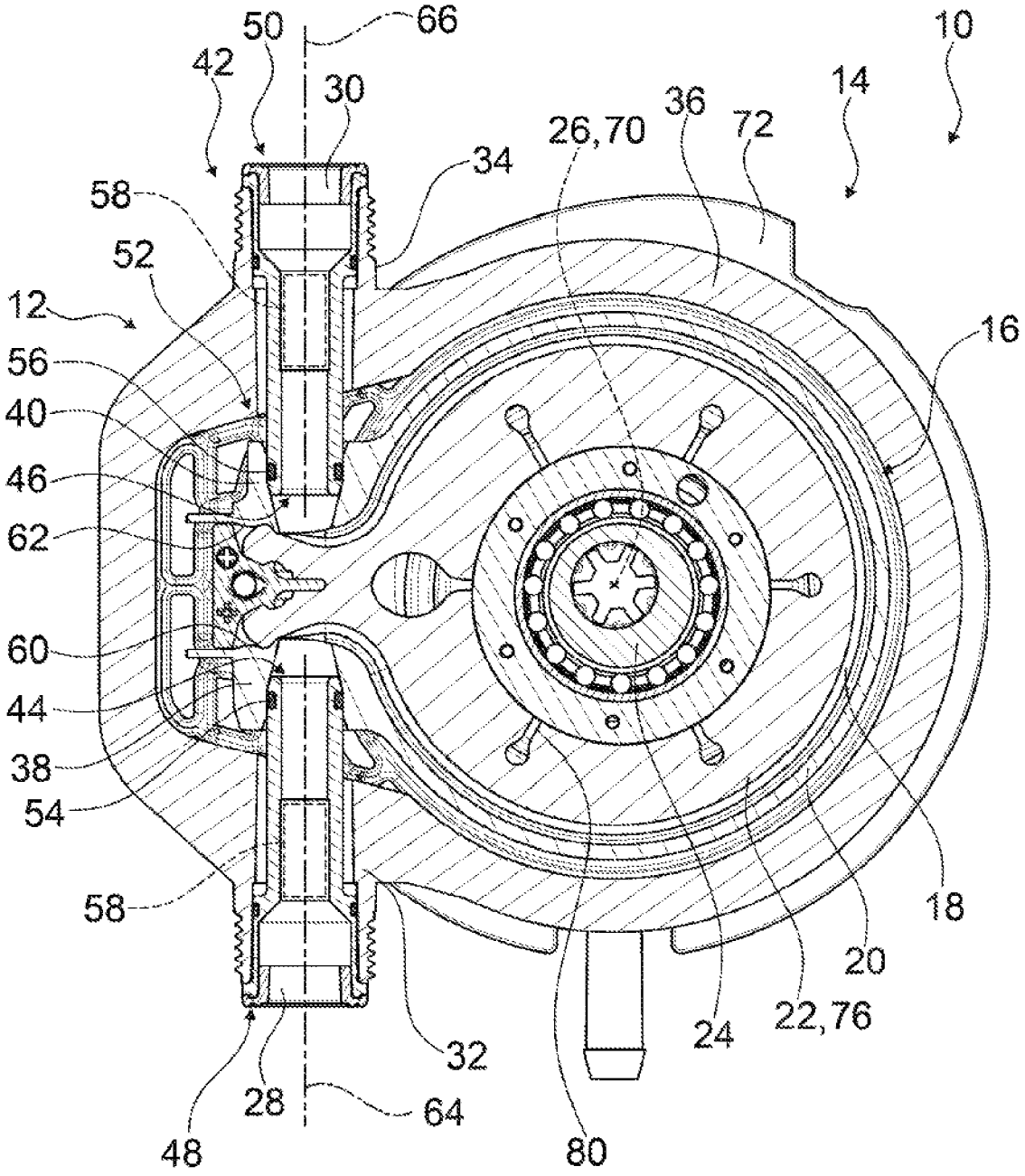
FIG. 3 shows a schematic section through the inventive pump.

Viewed along the principal axis/axes 64, 66 of the connecting piece 38 and/or, in particular, the additional connecting piece 40, the connecting piece 38 and/or, in particular, the additional connecting piece 40 is/are spaced apart from an inner wall of the housing 14, particularly at least the upper housing part 36 and/or the lower housing part 72, when the conveyor device 12 is arranged in the housing 14 (see FIGS. 2 and 3). The connecting piece 38 and/or, in particular, the additional connecting piece 40 preferably is spaced apart from the inner wall of the housing 14, particularly from an inner side of the upper housing part 36 and/or an inner side of the lower housing part 72, along an entire circumference of the connecting piece 38 and/or, in particular, the additional connecting piece 40 when the conveyor device 12 is arranged in the housing 14. A minimum distance of the connecting piece 38 and/or, in particular, the additional connecting piece 40 from the inner wall of the housing 14, particularly from the inner side of the upper housing part 36 and/or from the inner side of the lower housing part 72, preferably is greater than 0.001 mm, particularly greater than 0.01 mm and especially greater than 0.1 mm and smaller than 10 mm. The minimum distance of the connecting piece 38 and/or, in particular, the additional connecting piece 40 from the inner wall of the housing 14, particularly from the inner side of the upper housing part 36 and/or from the inner side of the lower housing part 72, preferably has a value that lies in the range between 0.1 mm and 5 mm. In an alternative design of the pump 10, however, it is also conceivable that the connecting piece 38 and/or, in particular, the additional connecting piece 40 abuts on the inner wall of the housing 14, particularly on the inner side of the upper housing part 36 and/or the inner side of the lower housing part 72, and is supported on the inner wall of the housing 14, particularly on the inner side of the upper housing part 36 and/or the inner side of the lower housing part 72, when the conveyor device 12 is arranged in the housing 14.

The conveyor chamber element 20 comprises at least the connecting piece 38 for the fluid supply line adapter 28, which particularly is designed to differ from a hose, and/or at least the additional connecting piece 40 for the fluid discharge line adapter 30, which particularly is designed to differ from a hose, wherein said connecting piece/s respectively is/are arranged on a side, particularly the outer side, of the conveyor chamber element 20 facing away from the conveyor element 22 (see FIGS. 2, 3, 5 and 7). The fluid supply line adapter 28 and/or the fluid discharge line adapter 30 preferably is/are designed in a tubular manner. The fluid supply line adapter 28 and/or the fluid discharge line adapter 30 preferably has/have a conically extending insertion end 44, 46 (see FIGS. 3 and 10). The insertion end 44, 46 of the fluid supply line adapter 28 and/or the fluid discharge line adapter 30 respectively is arranged in the connecting piece 38 or, in particular, in the additional connecting piece 40 when the fluid supply line adapter 28 and/or the fluid discharge line adapter is/are arranged on the conveyor chamber element 20. The fluid supply line adapter 28 and/or the fluid discharge line adapter 30 preferably comprises/comprise a coupling end 48, 50 for respectively being connected to a supply line or a discharge line for respectively supplying or discharging a fluid from or into the conveyor chamber 18. It is also conceivable that the fluid supply line adapter 28 and/or the fluid discharge line adapter 30 is/are intended for producing a connection with different components deemed sensible by a person skilled in the art, e.g. fluid couplers, hose connectors or the like. The coupling end 48, 50 is arranged on a side of the fluid supply line adapter 28 or the fluid discharge line adapter 30 that faces away from the insertion end 44, 46. The fluid supply line adapter 28 and the fluid discharge line adapter 30 preferably have an at least essentially identical design. However, it is also conceivable that the fluid supply line adapter 28 and the fluid discharge line adapter 30 are at least partially designed differently, e.g. in the form of a functional unit 58 or the like.

Figure 10:
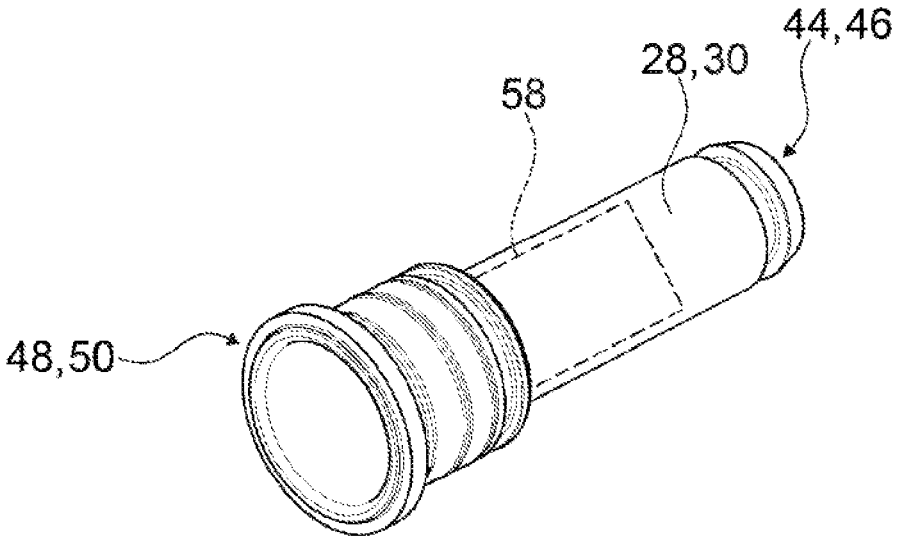
FIG. 10 shows a schematic representation of a fluid supply line adapter or a fluid discharge line adapter of the inventive conveyor device.

The conveyor device 12 comprises at least one functional unit 58, particularly a filter unit and/or a valve unit, as well as the fluid supply line adapter 28 and/or the fluid discharge line adapter 30, wherein the functional unit 58 is at least partially, in particular completely, arranged in the fluid supply line adapter 28 and/or in the fluid discharge line adapter 30 (see FIGS. 2, 3 and 10). The functional unit 58 preferably is at least partially, in particular completely, integrated into the fluid supply line adapter 28 and/or into the fluid discharge line adapter 30 in a permanent manner or at least partially, in particular completely, arranged in the fluid supply line adapter 28 and/or in the fluid discharge line adapter 30 in an exchangeable manner. For example, the functional unit 58 may have one or, in particular, two filter and/or valve cartridge/s that respectively is/are arranged in the fluid supply line adapter 28 or in the fluid discharge line adapter 30. Different designs or arrangements of the functional unit 58 deemed sensible by a person skilled in the art are likewise conceivable, e.g. an arrangement between the connecting piece 38 and the fluid supply line adapter 28 or between, in particular, the additional connecting piece 40 and the fluid discharge line adapter 30 or the like.

The fluid supply line adapter 28 and/or the fluid discharge line adapter 30 is/are arranged on the housing 14, particularly on the upper housing part 36 and/or on the conveyor chamber element 20, in a removable manner. The pump 10 comprises at least one securing unit 42 for securing the fluid supply line adapter 28 and/or the fluid discharge line adapter 30 on the housing 14, particularly on the upper housing part 36, by means of a form-fitting and/or frictional connection. The securing unit 42 preferably comprises an external thread, particularly two external threats, that particularly is/are arranged on an outer side of the receptacle/s 32, 34 (see FIG. 1). It is conceivable that the securing unit 42 comprises at least one (not-shown) screw cap, particularly two screw caps, that interacts/intact with the external thread/s and, in particular, firmly clamp a collar of the fluid supply line adapter 28 and/or the fluid discharge line adapter 30 in order to secure the fluid supply line adapter 28 and/or the fluid discharge line adapter 30 on the housing 14. It is preferred that the securing unit 42 alternatively or additionally comprises at least the internal thread/s arranged on the receptacle/s 32, 34. It is furthermore conceivable that the securing unit 42 alternatively or additionally comprises different components deemed sensible by a person skilled in the art for securing the fluid supply line adapter 28 and/or the fluid discharge line adapter 30 on the housing 14, particularly on the upper housing part 36, by means of a form-fitting and/or a frictional connection, e.g. a securing ring, a securing pin or the like.

The conveyor device 12 comprises at least one movement compensation unit 52 that is at least intended for at least partially compensating and/or damping relative movements between the fluid supply line adapter 28 and the connecting piece 38 when the connecting piece 38 is connected to the fluid supply line adapter 28 and/or for at least partially compensating and/or damping relative movements between the fluid discharge line adapter 30 and, in particular, the additional connecting piece 40 when the additional connecting piece 40 is connected to the fluid discharge line adapter 30 (see FIG. 3). The movement compensation unit 52 preferably comprises at least one damping element 54, particularly at least two damping elements 54, 56. The damping element/s 54, 56 preferably is/are designed in the form of an O-ring. However, it is also conceivable that the damping element/s 54, 56 has/have a different design deemed sensible by a person skilled in the art, e.g. in the form of an elastomer disk, a hollow elastomer cylinder or the like. It is preferred that the damping element/s 54, 56 respectively is/are arranged between the connecting piece 38 and the fluid supply line adapter 28 or between, in particular, the additional connecting piece 40 and the fluid discharge line adapter 30. The damping element/s 54, 56 particularly abuts/abut on an inner side of the connecting piece 38 and on an outer side of the insertion end 44 of the fluid supply line adapter 28 and/or on an inner side, in particular, of the additional connecting piece 40 and on an outer side of the insertion end 46 of the fluid discharge line adapter 30. In addition to damping a movement, the damping element/s 54, 56 preferably is/are also intended for respectively producing a fluidic seal between the connecting piece 38 and the fluid supply line adapter 28 and/or for producing a fluidic seal, in particular, between the additional connecting piece 40 and the fluid discharge line adapter 30.

Figure 6:
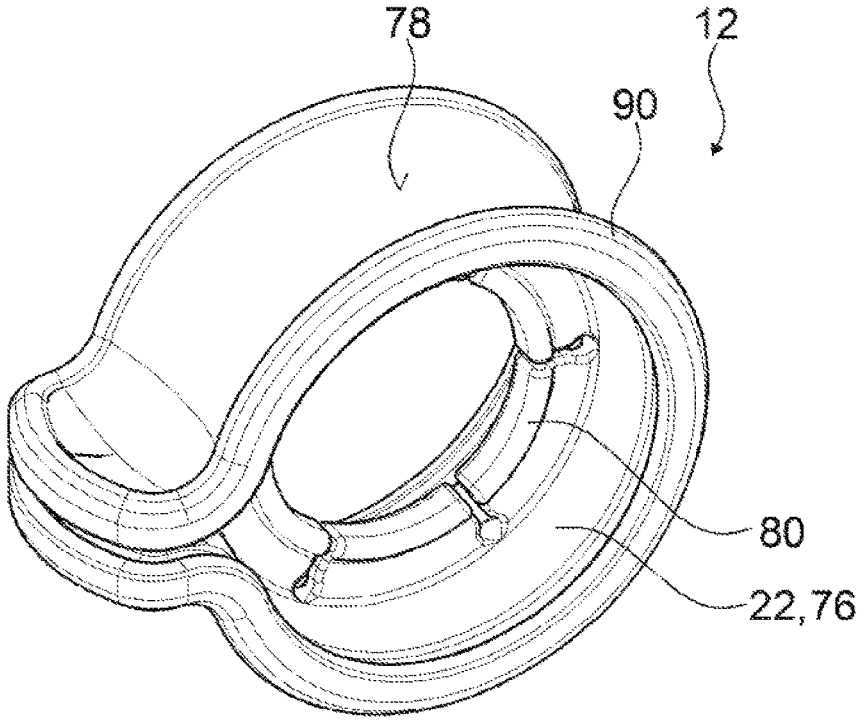
FIG. 6 shows a schematic representation of a conveyor element of the inventive conveyor device.

The conveyor element 22 comprises at least one base body 76 that particularly is at least essentially designed in an annular manner (see FIGS. 3 and 6), wherein said base body can be elastically deformed and has at least one conveying surface 78 that is arranged on a conveying side of the base body 76. Furthermore, the conveyor element 22 preferably comprises at least one activation extension 80, particularly a plurality of activation extensions 80, for being connected to at least one transmission element 82 of the drive unit 16, which interacts with the activation extension 80, particularly with the plurality of activation extensions 80, on an activation side of the base body 76. The conveying side of the base body 76 preferably is arranged on the base body 76 on a side of the base body 76 that faces away from the activation side of the base body 76. The conveying side particularly forms an outer side of the base body 76. The activation side preferably forms an inner side of the base body 76. The inner side of the base body 76 particularly is at least partially formed by the activation side. The activation extension 80, particularly the activation extensions 80, particularly is/are designed integrally with the base body 76. However, it is also conceivable that the activation extension 80, particularly the activation extensions 80, is/are formed separately from the base body 76 and fixed on the base body 76 by means of a form-fitting and/or frictional connection deemed sensible by a person skilled in the art.

The activation extension 80, particularly the activation extensions 80, is/are designed in the form of form-fit and/or frictional engagement element/s that interacts/intact with the transmission element 82 by means of a form-fitting and/or frictional connection, particularly a form-fitting and/or frictional connection that is not firmly bonded, in order to at least transmit a driving force acting in a direction facing away from the activation side. The activation extension 80, particularly the activation extensions 80, preferably is/are clamped between two transmission elements 82, particularly transmission rings, that are arranged on the driving element 24 (see FIG. 4). Viewed along a circumferential direction extending around the drive axis 70 of the drive unit 16, in particular, the activation extension 80, particularly the activation extensions 80, has/have a maximum longitudinal extent that is smaller than a maximum longitudinal extent of the base body 76.

Viewed in a plane, particularly in a plane extending at least essentially perpendicular to the drive axis 70, the base body 76 preferably has a cross-sectional shape that essentially is composed of a circular arc or an open ring and two inlet and/or outlet extensions that extend transverse to the circular arc or the open ring. The circular arc or the open ring of the cross-sectional shape of the base body 76 preferably extends along an angular range of less than 360° and, in particular, more than 90°. The inlet and/or outlet extensions of the cross-sectional shape of the base body 76, which extend transverse to the circular arc or the open ring, preferably are arranged such that they directly border on the circular arc or the open ring, particularly in end regions of the circular arc or the open ring. The activation extension 80, particularly the activation extensions 80, preferably extends/extend along a closed circular ring, wherein the activation extension 80, particularly the activation extensions 80, may form the circular ring itself/themselves. A maximum extent of the activation extension 80 along a central axis of the base body 76 or an overall extent of the multiple successive activation extensions 80 along a central axis of the base body 76 particularly is at least 5% smaller, preferably at least 10% and especially at least 20% smaller, than a maximum longitudinal extent of the base body 76. It is preferred that the activation extension 80 or the multiple successive activation extensions 80 altogether particularly extends/extend along an angular range of more than 270°, preferably less than 360° or 360°, on the activation side.

Figure 5:
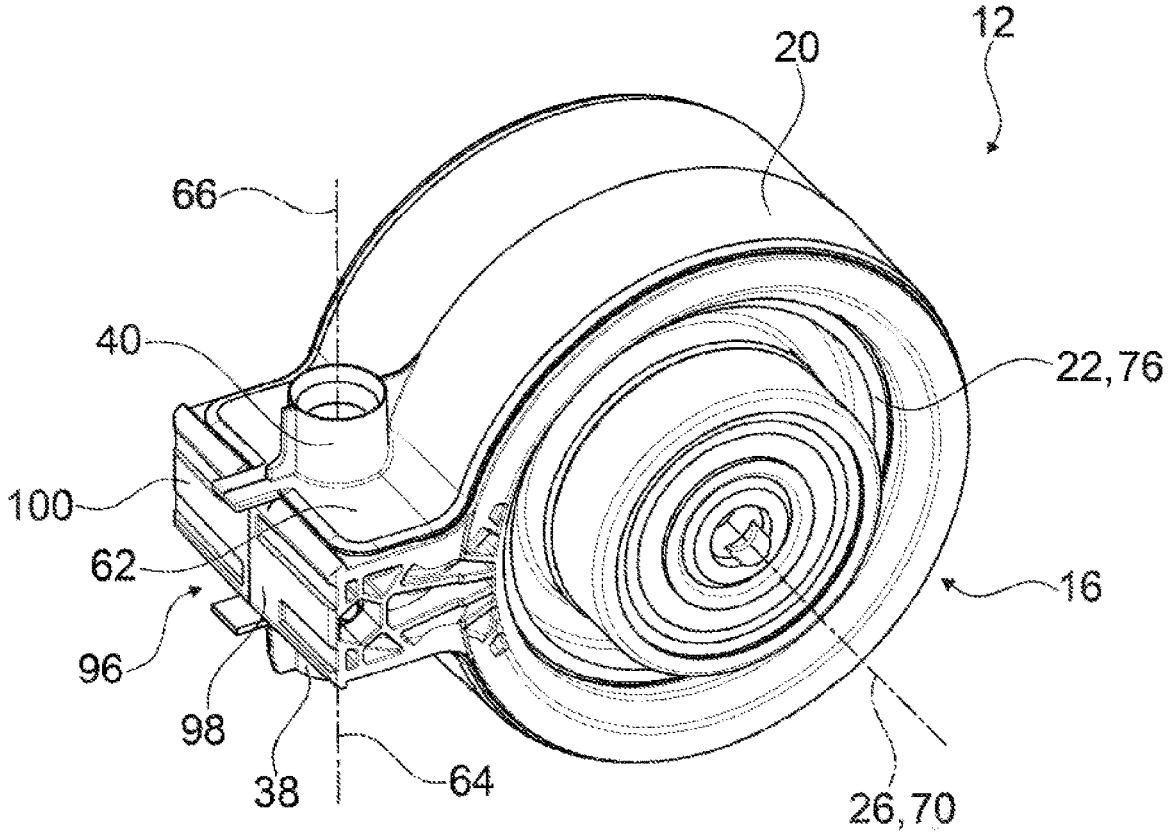
FIG. 5 shows a schematic representation of the inventive conveyor device in a state, in which it is removed from the housing of the pump.

The conveyor chamber element 20 at least mostly surrounds the conveyor element 22 along a circumferential direction extending, in particular, in a plane that at least essentially lies perpendicular to the drive axis 70 of the drive unit 16 (see FIGS. 3 and 5). The conveyor chamber element 20 is designed in an annular manner. The conveyor chamber element 20 and the conveyor element 22 preferably have an at least essentially analog shape, particularly viewed in the plane extending at least essentially perpendicular to the drive axis 70 of the drive unit 16. The conveyor chamber element 20 and the conveyor element 22, in particular the base body 76 of the conveyor element 22, particularly have a basic shape that resembles an uppercase Greek letter Omega, wherein the extensions of the conveyor chamber element 20 and the conveyor element 22 preferably are angled relative to extensions of the uppercase Greek letter Omega by 90°.

Figure 4:
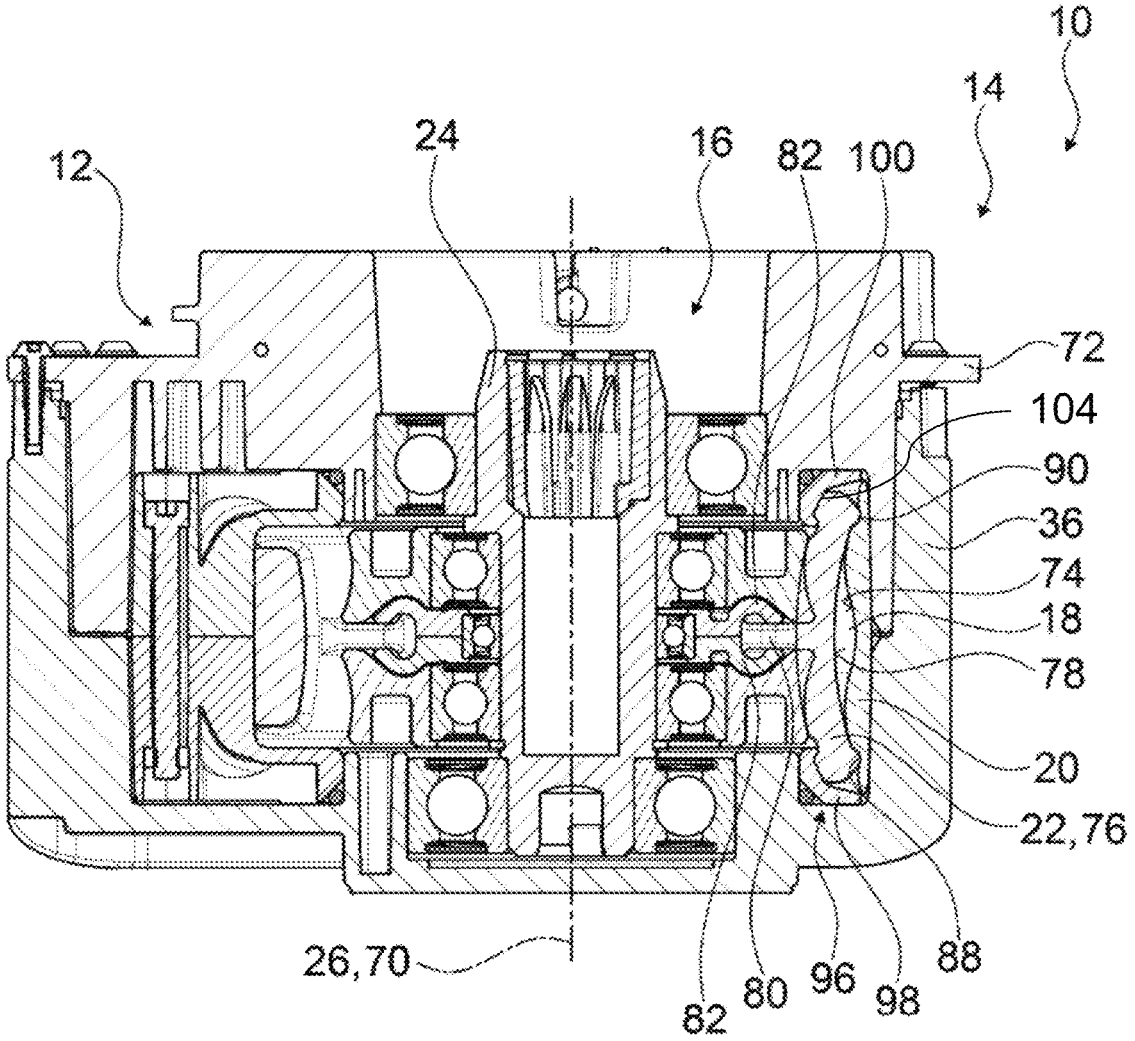
FIG. 4 shows another schematic section through the inventive pump.
Figure 7:
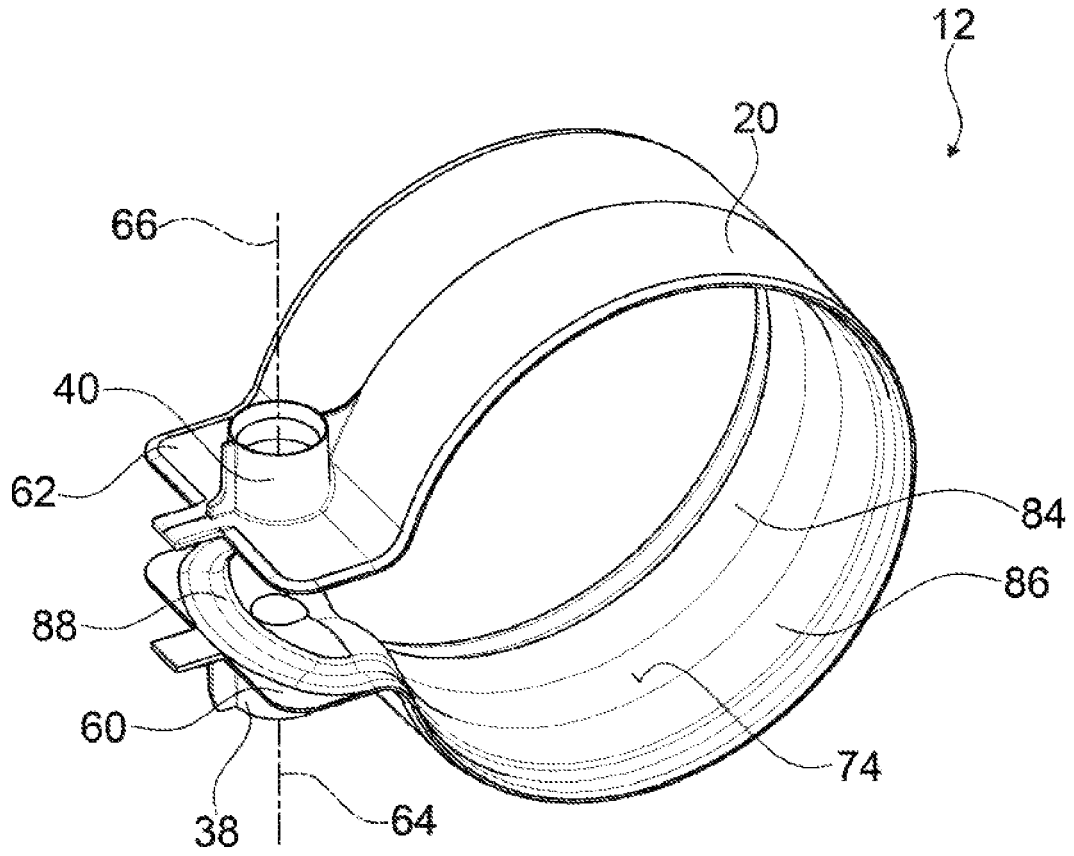
FIG. 7 shows a schematic representation of a conveyor chamber element of the inventive conveyor device.
Figure 8:
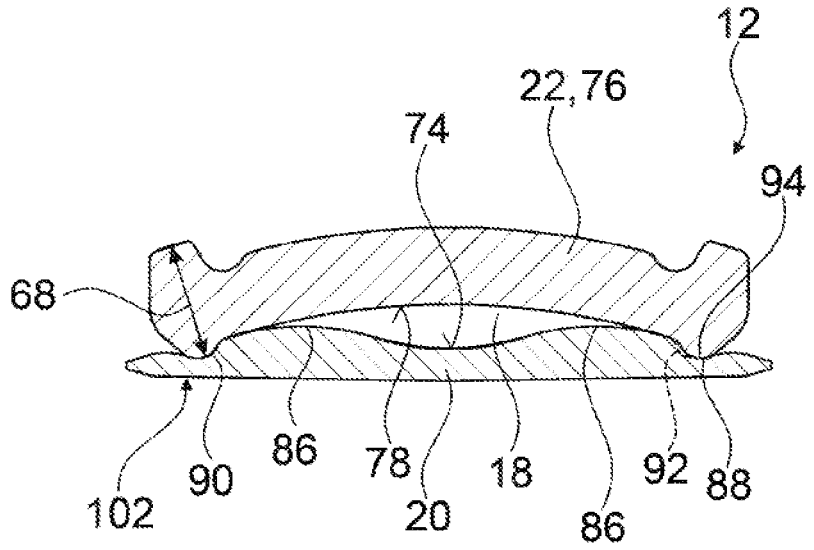
FIG. 8 shows a schematic partial section through the conveyor element and the conveyor chamber element.

The conveyor chamber element 20 has a counter surface 74 that interacts with the conveying surface 78 of the conveyor element 22 in order to convey a fluid, wherein said counter surface faces the conveyor element 22 and has at least one elevation 84, 86 that is oriented in the direction of the conveyor element 22 (see FIGS. 4, 7 and 8). The counter surface 74 preferably comprises at least two elevations 84, 86 that are oriented in the direction of the conveyor element 22. Viewed along the circumferential direction, the elevation/s 84, 86 extends/extend along an at least essentially entire inner side of the conveyor chamber element 20, which particularly extends in the shape of a circular arc. The elevation/s 84, 86 preferably extends/extend over the inner side of the conveyor chamber element 20 from one of the transverse extensions 60, 62 to the other transverse extension 60, 62 along the circular arc or the open ring.

The conveyor element 22, particularly the base body 76, has the conveying surface 78, which viewed in a cross section of the conveyor element 22, particularly in a cross section of the conveyor chamber 18, has a maximum transverse extent that at least essentially, in particular completely, corresponds to a maximum transverse extent of the counter surface 74 of the conveyor chamber element 20 (see FIGS. 4 and 8). In order to convey a fluid into and/or through the conveyor chamber 18, the conveying surface 78 particularly can be completely placed against the counter surface 74 of the conveyor chamber element 20 as a result of the effect of a driving force that can be generated by the drive unit 16. Viewed in a cross section of the conveyor chamber element 20, the counter surface 74 of the conveyor chamber element 20 has at least three successive circular arc sections. The circular arc sections form the counter surface 74. Two of the three circular arc sections form the elevations 84, 86 of the counter surface 74 and are arranged on the outside. One of the three circular arc sections forms a depression and is arranged on the inside, particularly between the elevations 84, 86. It is conceivable that the three circular arc sections have different or identical radii.

The conveyor chamber element 20 has at least one connecting region, particularly at least one connecting groove, preferably a sealing groove 88, which is arranged, in particular, on the inner side of the conveyor chamber element 20, wherein at least an edge region of the conveyor element 22, particularly an extension, preferably a sealing extension 90, of the conveyor element 22 arranged on the edge of the conveyor element 22 engages into said sealing groove, particularly in a sealing manner, when it is arranged on the conveyor chamber element 20 (see FIGS. 4 and 8). The conveyor element 22 has at least the sealing extension 90, which is designed integrally with the base body 76 of the conveyor element 22 and at least partially arranged in the sealing groove 88 of the conveyor chamber element 20 when the conveyor element 22 is arranged on the conveyor chamber element 20. The sealing groove 88 is designed in such a way that the sealing extension 90 and an edge region 92 of the conveyor chamber element 20 delimiting the sealing groove 88 flatly abut on one another. The sealing groove 88 and the edge region 92 of the conveyor chamber element 20 delimiting the sealing groove 88, which is arranged on a side of the sealing groove 88 facing the conveying surface 78 of the base body 76 of the conveyor element 22, are designed in such a way that the sealing extension 90 flatly abuts on the edge region 92 of the conveyor chamber element 20 delimiting the sealing groove 88 and on a groove base 94 of the sealing groove 88. The sealing groove 88 extends completely around the counter surface 74 of the conveyor chamber element 20, which interacts with the conveying surface 78 of the base body 76 of the conveyor element 22 in order to convey a fluid, and delimits the counter surface 74. The sealing groove 88 preferably extends on the transverse extensions 60, 62 of the conveyor chamber element 20 around a respective inlet or outlet opening in the respective transverse extension 60, 62 and transforms, particularly in a seamless manner, into the annular inner side of the conveyor chamber element 20 in order to delimit the counter surface 74. The sealing groove 88 preferably extends along an entire inner edge region of the conveyor chamber element 20. The conveyor chamber element 20 has the counter surface 74 for interacting with the conveying surface 78 of the base body 76 of the conveyor element 22 in order to convey a fluid, wherein said counter surface 74 extends over at least three circular arc sections that are arranged successively, particularly when viewed in a cross section, wherein at least the edge region 92 of the conveyor chamber element 20 delimiting the sealing groove 88 is arranged such that it borders, in particular directly, on at least one of the three circular arc sections, particularly on an outer circular arc section.

The sealing extension 90 extends completely around the conveying surface 78 of the base body 76 of the conveyor element 22 and delimits the conveying surface 78. The sealing extension 90 preferably extends along an entire outer circumference of the base body 76. The sealing extension 90 preferably extends around the inlet and/or outlet extensions of the base body 76 and transforms, particularly in a seamless manner, into the annular basic shape of the base body 76 in order to delimit the conveying surface 78. The sealing extension 90 preferably has a transition region toward an edge region of the base body 76 of the conveyor element 22, wherein a cross section of said transition region differs from a cross section of an additional transition region of the sealing extension 90 toward the conveying surface 78 of the base body 76 (see FIG. 8).

Figure 9:
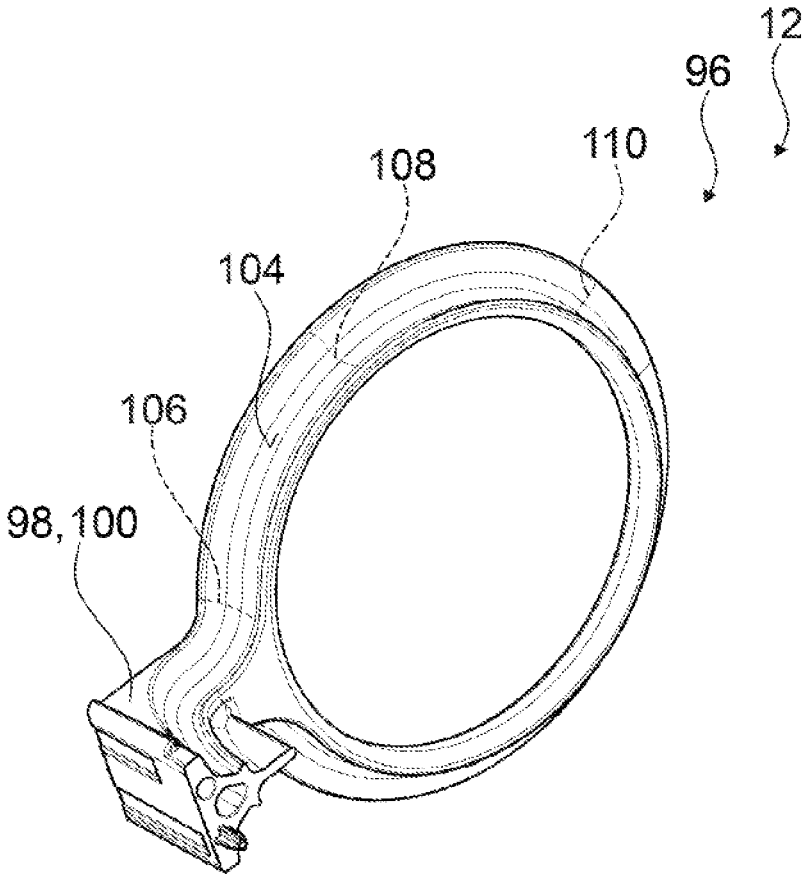
FIG. 9 shows a schematic representation of a pressing element of a pressing unit of the inventive conveyor device.

The conveyor device 12 furthermore comprises at least one pressing unit 96 that has at least one pressing element 98, 100, particularly at least one clamping ring, which is designed for acting upon the sealing extension 90 with a pressing force in the direction of the conveyor chamber element 20 and for compressing the sealing extension 90 at least in the region of the sealing groove 88 (see FIGS. 4, 5 and 9). The sealing extension 90 extends over the conveying surface 78 along a direction extending transverse, particularly at least essentially perpendicular, to the conveying surface 78 of the base body 76 of the conveyor element 22. At least in a non-conveying state of the conveyor element 22, in particular, the pressing unit 96 is intended for generating an inhomogeneous pressing force at least in a sealing region 102 between the conveyor element 22 and the conveyor chamber element 20 along a maximum overall extent of the sealing region 102, particularly along a maximum circumferential extent between the conveyor element 22 and the conveyor chamber element 20. The sealing region 102 preferably is formed due to an interaction of the sealing groove 88 and the sealing extension 90. The pressing unit 96 preferably is intended for generating an inhomogeneous pressing force distribution along a sealing line of the conveyor element 22, which particularly extends along a circumferential direction of the conveyor element 22. The sealing line preferably is formed by the sealing extension 90.

The pressing unit 96 preferably is designed in such a way that the conveyor element 22 has an inhomogeneous compression, particularly at least in a non-conveying state of the conveyor element 22, along the maximum overall extent of the sealing region 102 or the sealing line, particularly along a maximum circumferential extent of the annular conveyor element 22. The pressing unit 96 has at least one pressing element 98, 100, particularly at least one clamping ring, wherein the conveyor element 22 is designed in an annular manner and pressed against an inner circumference of the annular conveyor chamber element 20 by means of the pressing element 98, 100. The pressing unit 96 preferably comprises at least two pressing elements 98, 100, particularly two clamping rings, between which the conveyor element 22 is arranged within the conveyor chamber element 20. The conveyor element 22 preferably can be pressed against the inner circumference of the annular conveyor chamber element 20 by means of the pressing elements 98, 100. The sealing extension 90 particularly is pressed into the sealing groove 88 due to the effect of the pressing element 98, 100 on the conveyor element 22. The pressing unit 96 has at least the pressing element 98, 100, particularly at least the clamping ring, wherein the conveyor element 22 has at least the sealing extension 90, and wherein the pressing element 98, 100 presses the sealing extension 90 against the conveyor chamber element 20, in particular, at least along a circumferential direction of the conveyor chamber element 20, particularly with an inhomogeneous pressing force along the circumferential direction. The pressing unit 96 has at least the pressing element 98, 100, particularly at least the clamping ring, that has a pressing surface 104, wherein said pressing surface has a varying level, in particular a varying distance from a surface, particularly an inner surface, of the pressing element 98, 100 facing away from the pressing surface 104, along a maximum longitudinal extent of the pressing surface 104 extending, in particular, along a circumferential direction of the pressing elements 98, 100. The varying level of the pressing surface 104 preferably is formed by different maximum heights of the pressing surface 104 along the circumferential direction. As an example, FIG. 9 shows with broken lines three different positions 106, 108, 110 on the pressing element 98, in which the pressing surface 104 is intended for generating different degrees of compression of the sealing extension 90. The pressing surface 104 particularly has in the three different positions 106, 108, 110 different maximum heights that can be formed in various ways, e.g. by varying a maximum thickness of the pressing element 98 in the three positions 106, 108, 110 in comparison with other positions of the pressing element 98, by varying a geometric extent of the pressing surface 104 on a side of the pressing element 98 facing the conveyor element 22 or in a different way deemed sensible by a person skilled in the art. For example, the sealing extension 90 is compressed to different degrees in the positions 106, 108, 110 as a result of the varying level. In position 106, for example, the sealing extension 90 is compressed, in particular, by more than 10%, preferably more than 15%, particularly more than 20%, and especially more than 22%, of a maximum thickness 68 of the sealing extension 90. In position 108, for example, the sealing extension 90 is compressed, in particular, by more than 5%, preferably more than 10%, particularly more than 15% and especially more than 19%, of the maximum thickness 68 of the sealing extension 90. In position 110, for example, the sealing extension 90 is compressed, in particular, by more than 4%, preferably more than 8%, particularly more than 14% and especially more than 16%, of the maximum thickness 68 of the sealing extension 90.

The pressing unit 96 has at least the pressing element 98, particularly at least the clamping ring, and at least one additional pressing element 100, particularly at least one additional clamping ring, wherein the conveyor element 22 is designed in an annular manner and pressed against an inner circumference of the annular conveyor chamber element 22 by means of the pressing element 98 and the additional pressing element 100, and wherein the pressing element 98 and the additional pressing element 100 are arranged on the conveyor element 22 on opposite sides of the conveyor element 22. The pressing element 98 and the additional pressing element 100 of the pressing unit 96 preferably have an at least essentially analogous design. The pressing element 98 and the additional pressing element 100 are arranged on the conveyor chamber element 20 mirror-symmetrical, particularly in order to press the conveyor element 22 against the conveyor chamber element 20 and to press the sealing extension 90 into the sealing groove 88. The conveyor chamber element 20 has at least the groove, preferably the sealing groove 88, which particularly extends along an inner circumference of the annular conveyor chamber element 20 and into which at least the sealing extension 90 of the particularly annular conveyor element 22 is pressed by means of the pressing element 98, particularly the clamping ring, and/or by means of the additional pressing element 100 of the pressing unit 96, wherein a compression of the sealing extension 90 is inhomogeneous along a maximum longitudinal extent of the sealing extension 90, in particular, along a circumferential direction of the conveyor element 22. Alternatively or additionally to a varying level of the pressing surface 104 of the pressing element 98 and/or the additional pressing element 100, it is conceivable that the conveyor element 22 has at least the sealing extension 90, which is pressed against an inner circumference of the annular conveyor chamber element 20 by means of the pressing unit 96 and has a varying maximum thickness 68 along the maximum longitudinal extent of the sealing extension 90, particularly along a circumferential direction of the conveyor element 22. Different designs of the pressing unit 96 deemed sensible by a person skilled in the art for generating an inhomogeneous compression of the sealing extension 90 along the circumferential direction in the sealing region 102 are likewise conceivable.

The invention claimed is:

1. A conveyor device for at least conveying a fluid with at least one conveyor chamber, with at least one dimensionally stable conveyor chamber element that at least partially delimits the at least one dimensionally stable conveyor chamber, with at least one elastically deformable and annular conveyor element that delimits the at least one dimensionally stable conveyor chamber together with the at least one dimensionally stable conveyor chamber element and is arranged on the at least one dimensionally stable conveyor chamber element, and with at least one pressing unit having at least one pressing element, the at least one pressing unit generating an inhomogeneous pressing force in a non-conveying state of the conveyor element, at least in a sealing region between the conveyor element and the at least one dimensionally stable conveyor chamber element along a maximum overall extent of the sealing region and along a maximum circumferential extent between the conveyor element and the at least one dimensionally stable conveyor chamber element, wherein the pressing unit is designed in such a way that the conveyor element has an inhomogeneous compression in at least a non-conveying state of the conveyor element, along the maximum overall extent of the sealing region along a maximum circumferential extent of the annular conveyor element, wherein the annular conveyor element is compressed to different degrees by the pressing unit along the maximum overall extent of the sealing region and along the maximum circumferential extent of the annular conveyor element, as a result of a geometric design of a pressing surface of the at least one pressing element of the at least one pressing unit; and wherein the at least one pressing element is a clamping ring, the clamping ring includes a pressing surface on a side of the clamping ring facing the annular conveyor element, the pressing surface has a varying distance from an inner surface of the clamping ring facing away from the pressing surface, along a maximum longitudinal extent of the pressing surface in a circumferential direction of the at least one pressing element.

2. The conveyor device according to claim 1, wherein the annular conveyor element and the at least one dimensionally stable conveyor chamber element are each designed in an annular manner, and wherein the annular conveyor element is pressed against an inner circumference of the annular conveyor chamber element by means of the clamping ring.

3. The conveyor device according to claim 1, wherein the annular conveyor element has at least one sealing extension, and wherein the pressing element presses the sealing extension against the at least one dimensionally stable conveyor chamber element along a circumferential direction of the at least one dimensionally stable conveyor chamber element, with an inhomogeneous pressing force along the circumferential direction.

4. The conveyor device according to claim 1, wherein the annular conveyor element has at least one sealing extension, which is pressed against an inner circumference of the annular conveyor chamber element by means of the pressing unit and has a varying maximum thickness along a maximum longitudinal extent of the sealing extension along a circumferential direction of the annular conveyor element.

5. The conveyor device according to claim 1, characterized in that the at least one pressing element includes at least one additional pressing element, the additional pressing element being an additional clamping ring, wherein the annular conveyor element is pressed against an inner circumference of the at least one dimensionally stable conveyor chamber element by means of the pressing element and the additional pressing element, and wherein the pressing element and the additional pressing element are arranged on the annular conveyor element so as to be on opposite sides of the annular conveyor element.

6. The conveyor device according to claim 1, characterized in that the at least one dimensionally stable conveyor chamber element has at least one sealing groove extending along an inner circumference of the annular conveyor chamber element, wherein at least one sealing extension of the annular conveyor element is pressed into said at least one sealing groove by means of a pressing element of the pressing unit, particularly the clamping ring of the pressing unit, and wherein a compression of the sealing extension is inhomogeneous along a maximum longitudinal extent of the sealing extension along a circumferential direction of the annular conveyor element.

7. A pump with at least one conveyor device according to claim 1.

8. The pump according to claim 7, characterized by at least one drive unit that has at least one driving element, one of the at least one driving element being an eccentric shaft, which is substantially surrounded by the at least one dimensionally stable conveyor chamber element, the annular conveyor element and the pressing unit extending around the drive axis of the drive unit when viewed along a circumferential direction.

* * * * *